US006330881B1

(12) United States Patent
Pippard

(10) Patent No.: US 6,330,881 B1
(45) Date of Patent: Dec. 18, 2001

(54) TORQUE BALANCED BOW QUIVER

(76) Inventor: Jeffrey J. Pippard, 223 Witmer Rd., North Tonawanda, NY (US) 14120

( * ) Notice: Subject to any disclaimer, the term of this patent is extended or adjusted under 35 U.S.C. 154(b) by 0 days.

(21) Appl. No.: 09/415,077

(22) Filed: Oct. 12, 1999

(51) Int. Cl.[7] ..... F41B 5/06; F41B 5/10
(52) U.S. Cl. ..... 124/25.7; 124/25.6; 124/86
(58) Field of Search ..... 124/25.5, 25.6, 124/25.7, 86, 88; 224/916

(56) References Cited

U.S. PATENT DOCUMENTS 2,969,898 * 1/1961 Ramsey ..... 124/25.7
2,999,620 * 9/1961 Haggard ..... 124/25.7 X
3,595,214 * 7/1971 O'Malley et al. ..... 124/25.7
4,377,152 * 3/1983 Saunders ..... 124/88
4,607,606 * 8/1986 Schaar ..... 124/88 X
4,704,800 * 11/1987 Stinson ..... 124/88 X
4,995,372 * 2/1991 Topel ..... 124/25.5
5,001,837 * 3/1991 Bray ..... 33/265
5,265,584 * 11/1993 Judson et al. ..... 124/86

* cited by examiner

*Primary Examiner*—John A. Ricci

(57) ABSTRACT

A unique low profile archery bow quiver is disclosed wherein a cable guard removably grips a plurality of arrows along their shafts, the heads of the arrows are removably gripped by an arrow head receiver, and the arrows are stored in the quiver in a plane which crosses the longitudinal arrow launching plane of the bow.

23 Claims, 3 Drawing Sheets

TORQUE BALANCED BOW QUIVER

TECHNICAL FIELD

The present invention relates to the general field of archery, specifically to archer's bow quivers, and more particularly to a bow quiver arranged in balanced alignment with the longitudinal centerline of an archer's bow, to provide an archer with a convenient quivered supply of reserve shooting arrows for sequential arrow reload, without sacrifice to the critical shooting balance of a selected bow.

BACKGROUND OF THE INVENTION

Archery is a popular sport and hobby which has gained increasing popularity for use in hunting and rapid shooting contests. Constant factors in archery are the interfering bulk of the bow, maintaining a critical shooting balance and the convenience of means available to the archer to assure a ready supply of arrows as the need arises. With the popularity of sporting contests and hunts involving movement of the archer from position to position, the convenience of a quiver which enables minimum motion reloading has become particularly desirable.

Particularly in the sport of bow hunting, it is generally necessary to get as close as possible to the quarry in order to assure that the arrow finds its mark. In the hunting environment, it is not unusual for a bow hunter to be required to stand in a still position to avoid detection by the quarry, and in many instances, movement that may be necessary to load or reload a bow is detected by the quarry and the opportunity to shoot is lost. Loading or nocking an arrow, or reloading an arrow after a missed shot, typically requires movement by the hunter which can easily be detected by the quarry. Thus, it is desirable to have a convenient means and location for storing arrows which allows the archer to load and reload with minimum detectable arm and hand movement.

Modern bows are sophisticated devices which are carefully engineered and balanced to provide an accurate platform for the repeatable accurate release of arrows. Generally, the hand grip and arrow rest are positioned as close to the centerline of the arc of the bow as possible so that the hand of the archer supporting the bow can effortlessly maintain the bow generally perpendicular when an arrow is nocked and the bow drawn to a shooting tension. Special sights and stringing means have been developed to assure the accuracy of the flight of an arrow, each of which are generally keyed to the centerline of the arc of the drawn bow and the ability of the archer to maintain the arrow along the centerline of the arc in an arrow launch plane during release to a target.

The prior art is replete with various quiver means for storing arrows on a bow and various devices for reloading arrows. Typically quiver means store the arrows in an arrangement generally parallel to the longitudinal axis of the bow which add bulk to the profile of the bow and require significant movement of the archer's arm and hand in order to remove the arrow from the quiver and reload the bow. Typically, the center of gravity of such quiver means loaded with reserve arrows is to the side of the longitudinal axis of the bow which creates additional forces at the extended hand of the archer which supports the bow in the shooting position. Thus, the hand of the archer which supports the bow is not only supporting the weight of the bow and nocked arrow in a raised position, but the additional weight of a loaded quiver mounted generally parallel to the longitudinal centerline of the bow creates torque force moments at the hand which must be counteracted to maintain the bow in a perpendicular position. This torque must be compensated for by an archer in his shooting habits and as the plurality of reserve arrows is spent, the change in weight changes the torque which must be compensated for. Further complicating the process, such parallel mounted quivers are generally arranged significantly spaced from the bow to assure clearance of the arrow during the shooting act, increasing the moment of torque at the hand and increasing the bulk of the profile of the bow, which is problematic in dense foliage and obviates the presence of the hunter to his quarry.

Arrow reloading means of the prior art typically maintain several arrows in a complex mechanical apparatus that requires multiple moving parts to function. Many of such means make mechanical sounds when they are functioning, that are distinct from the environmental background sounds and are easily detected by the quarry. Such complex means are subject to malfunction because of the dirt and rough handling imposed upon the equipment in field use.

It is an object of this application to provide a detachable means for convenient storage of arrows on a bow in a position amenable to rapid reloading.

Another object of the application is to provide a means that allows reloading a bow with minimum hunter movement.

A still further object of the invention is to provide a light-weight, non-complex device, that is adaptable for convenient attachment to any size archery bow, which will retain the center of gravity of the bow as close as possible to its longitudinal axis and allow minimum change in bulk to the profile of the bow.

These and other objects of the invention will be apparent from the following description of the invention.

SUMMARY OF THE INVENTION

Typically, archer's bows comprise a riser, which is that portion of the bow generally about the middle of the bow generally containing a hand grip and/or arrow shelf and/or arrow rest, and resilient upper and lower limbs which extend from opposite ends of the riser to the remote ends of the bow. The ends of the limbs generally comprise means such as notches, wheels, eccentrics or the like to engage a bowstring. Traditional bows, can be one piece or multiple piece units and may be straight, curved, re-curved and the like, generally comprising notches or the like at opposite ends for attachment of a bowstring. Modern bows are generally three piece units and can also be straight, curved, re-curved and the like and may also be compound actuated. Many modern and some traditional bows have one or more mounting hole(s), arranged in the riser section along about the longitudinal axis of the bow, for attaching various accessories which may be used by an archer. Most have a mounting hole located below the hand grip, but many modern bows arrange a mounting hole above the hand grip at about the center of the arc, sometimes referred to as the center of the axle to axle length of a compound bow and/or the centerline of the bow.

One embodiment of the quiver device of the instant invention comprises an arrow head receiver unit which is configured to receive and firmly engage the arrow head ends of a plurality of arrows, and an arrow shaft receiver unit which is configured to grip the shafts of the plurality of arrows at a point spaced rearwardly along the arrows from their respective arrow head ends. Both the arrow head receiver unit and the arrow shaft receiver unit are mounted to the riser portion of the bow, preferably with the arrow head receiver unit mounted above the hand grip and the arrow shaft receiver unit preferably combined with a cable guard unit of a modern compound bow and mounted to a cable guard mounting hole below the arrow head receiver unit. In a most preferred embodiment, the arrow head receiver unit is mounted to the riser of the bow at about the end thereof wherein the upper limb extends therefrom, while the arrow shaft receiver unit is mounted by means of the cable guard mounting hole in the riser, just below or above the hand grip.

In a most preferred embodiment, the bow comprises detachable limbs, and the remote end of a limb comprises an axle having an eccentric such as a wheel and the like, which engages a cable type bowstring. The arrow head receiver unit comprises an arrow head receiver means mounted to a mounting plate, an end of the mounting plate being mounted to about the upper end of the riser, with the arrow head receiver being positioned in the area between the bow and the bowstring in a plane spaced to one side of the arrow launching plane. By arrow launch plane is meant that plane generally defined as extending from about the longitudinal axis of the bow to the bowstring. The centerline of the arc of the bow is generally that location along the launch plane wherein an arrow is nocked, drawn and launched from the bow.

The arrow shaft receiver unit is mounted along a cable guard, the guard generally comprising an elongate element extending from a mounting hole of the bow to the cable bowstring in an arrangement which deflects the path of the non-drawn cable harness of a cable bowstring from interfering with a nocked arrow along the arrow launch plane. The arrows are mounted between the arrow head receiver and arrow shaft receiver in such manner that the shaft of the arrows cross the launch plane of the bow, but at a location spaced from the centerline of the arc of the bow.

In a further embodiment of the invention an elongate cable guard is offset mounted to the mounting hole and is configured to enable variable engagement against the non-drawn harness of the cable drawstring during draw of the drawn element of the drawstring.

In the arrangement of the invention, the arrow heads of the reserve arrows are retained on one side of the launch plane, while the nock ends of the arrows are retained at the other side of said plane, until they are removed for shooting. Such retention of the arrows crossing the launch plane of the bow, maintains a consistent balance of the bow during use by the shooter, reducing the torque moment which otherwise is added to the hand of the archer by the weight of parallel mounted quivers and arrows.

The arrangement of the invention further provides a significant reduction in complexity of the quiver and the amount of bulk generally added to the profile of the bow by quivers of the prior art. In the prior art, bow mounted quiver arrangements use complex and bulky frames, to assure secure, stable attachment of arrow retaining components in significant spaced relationship to the bow in order to avoid failure and/or interference with other operating components of the bow. In the present invention, the cross axis arrangement of arrow retention between the bow and the drawn element of the drawstring, enables a dual use configuration of an existing component, e.g. the cable guard, for securely mounting the shaft of the arrow in a non-complex low profile arrangement and minimal mounting framework for securely mounting the head portion of the arrow, thus significantly reducing the bulk of mounting frame-work. Similarly, the positioning of cross axis arrows precludes interference with the operation of the bow, while maintaining the reserve arrows in close proximity to the natural ready position of the archer's hands for drawing a bow, which fosters convenient finger tip removal and nocking of a reserve arrow without significant arm movement.

DETAILED DESCRIPTION OF THE INVENTION

Figure 1:
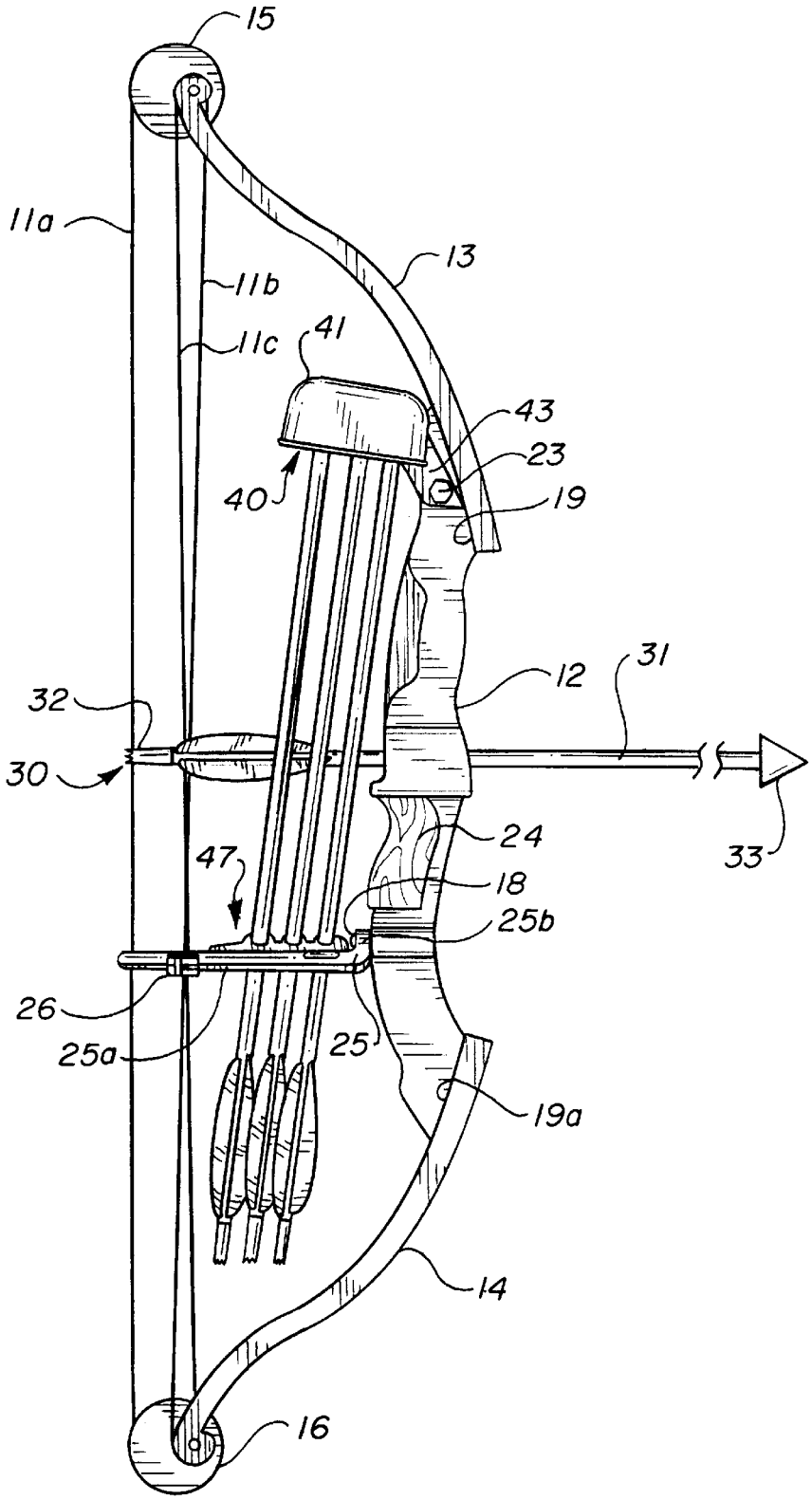
FIG. 1 is a side elevational view of a bow with a quiver arrangement illustrated holding a plurality of arrows in accordance with the invention.
Figure 2:
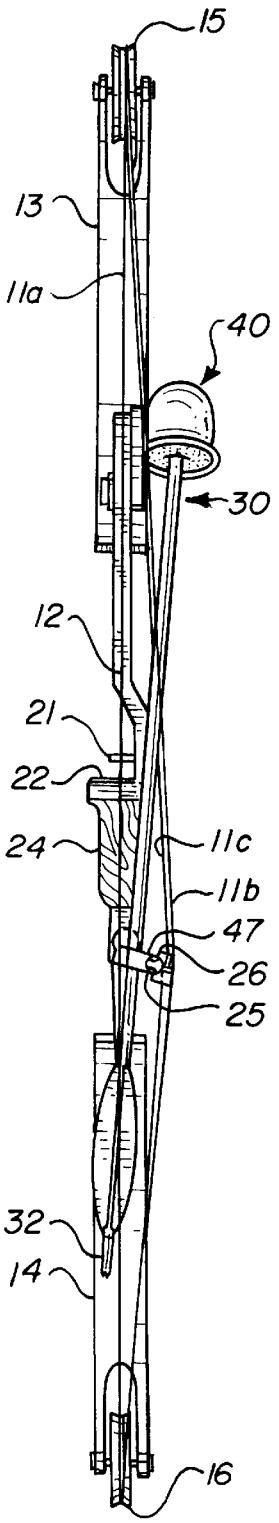
FIG. 2 is a rear elevational view of the bow of FIG. 1.
Figure 4:
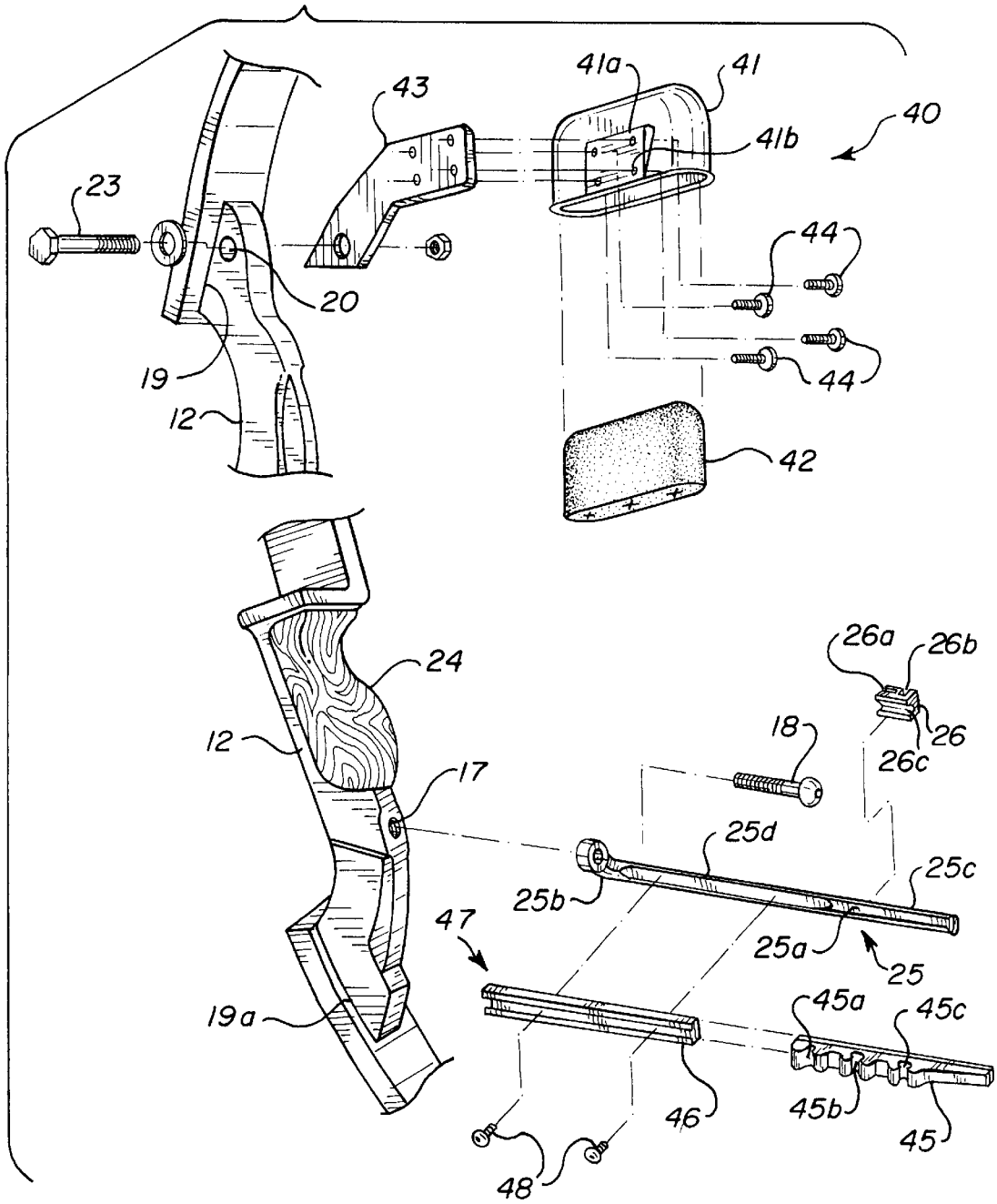
FIG. 4 is an exploded, fragmented perspective view of the bow of FIG. 1, illustrating the mounting of the quiver arrangement to the riser in accordance with the invention.

Referring first to the FIGS. 1, 2 and 4 of the drawings wherein a conventional modern compound cable bowstring archer's bow is illustrated as comprising a mounted quiver of the invention.

Therein the bow is illustrated as comprising a cable bowstring having drawing cable 11*a* and non-drawing, harness cables 11*b* and 11*c*, riser 12, detachable resilient limbs 13 and 14, and bowstring eccentric wheels 15 and 16. Riser 12 connects with first and second limbs 13 and 14 at connection/adjustment junctions 19 and 19*a* respectively. Riser 12 comprises an arrow rest 21, on which a nocked arrow can rest aligned in the shooting position, and hand grip 24 which comprises a slip resistant gripping surface. Cable guide 25 is illustrated as having an elongate guide member 25*a* extending into the arc of the bow, with an offset mounting end 25*b* extending angularly from elongate member 25*a* and comprising a hole for mounting the cable guide, by means of bolt 18, to mounting hole 17 of riser 12. Cable guide 25 is depicted as comprising cable harness restraint 26, which engages among harness cables 11*b*, 11*c* and cable guide 25. The quiver of the invention is depicted as comprising arrow head receiver unit 40 and arrow shaft receiver unit 47. Nocked arrow 30 is depicted in FIG. 1 only, and comprises arrow shaft 31, arrow nock 32 and arrow tip 33.

In the illustrated embodiment of FIGS. 1 and 2, the cable drawstring is illustrated as comprised of drawing cable 11*a* and two harness cables 11*b*, arranged with opposite ends of the drawing cable mounted to opposite wheels 15 and 16 and ends of the harness cables mounted to opposite eccentric supporting shafts, the drawing cable and harness cables arranged in an eccentric pulley mechanical advantage which reduces the force necessary to draw a bow. Both the harness cables and drawing cable extend tautly from axle end to axle end of the bow with cable being wound around the eccentrics as the arc of the bow is compressed by drawing the drawing cable. It should be understood that the depicted arrangement of cables and pulleys is merely illustrative and multiple different arrangements of eccentrics, wheels, cables and the like are contemplated as within the scope of the invention.

The draw cable and longitudinal central axis of the bow define an arrow launch plane, extending from about the longitudinal axis of the bow to about the longitudinal axis of the drawn cable, in which a drawn arrow passes during shooting. Nocking an arrow centers the rear of the arrow upon the axis of the drawing cable and maintains the rear of the arrow in the launch plane through release of the arrow from the draw cable. Modern bows generally comprise a riser which is notched 22 along the launch plane of the bow and an arrow rest 21 which places the front shaft of the arrow along the longitudinal axis of the bow at about its centerline, enabling accurate passage of the arrow along the launch plane through launch of the arrow from the bow. Harness cables would generally cross the launch plane, and to avoid interfering with the arrow during nocking and launching, is held in an angled position to the side thereof, by means of a cable guide.

In the illustrated embodiments of the figures, cable guide 25 comprises a cable harness restraint 26, which comprises cable slots 26*a,* 26*b* arranged for slidably capturing harness cables 11*b* and 11*c*. Elongate guide member 25*a* of cable guide 25 is offset from mounting end 25*b* to enable adjustment of elongate member 25*a* in a plane spaced from the arrow launch plane. Elongate member 25*a* comprises a rounded surface 25*c* through at least a portion of its length, while cable harness restraint 26 comprises a rounded surface 26*c* which is configured to matingly engage with rounded surface 25*c* of elongate member 25*a* in an arrangement which enables slidable engagement of cable harness restraint 26 along at least a portion of the length of elongate member 25*a,* while holding the harness cables spaced from the launch plane. As drawing cable 11*a* is pulled by the archer, the bow is bent into an arc by the shortening of harness cables 11*b* and 11*c*, and cable harness guide 26 slidably moves from a non-drawn rest position along elongate guide member 25*a* nearer to the riser to a drawn position along cable guide 25 spaced further from the riser, and back to the rest position with the archer's release of the drawing cable, while maintaining the harness cables spaced from the launch plane.

FIG. 4 illustrates in detail the quiver arrangement of FIGS. 1 and 2. Therein arrow shaft receiver unit 47 is illustrated as comprising holding plate 46 and resilient elastomeric element 45 mounted thereto. Each elastomeric element 45 comprises a plurality of integral "U" shaped resilient gripping clips 45*a–c* formed therein arranged to engage the shaft of the arrow. The holding plate is illustrated as screw 48 mounted to cable guard surface 25*d* arranged generally opposite curved surface 25*c* of elongate member 25*a* of cable guide 25. In a preferred embodiment, a generally flat surface is formed in the cable guard for mounting the holding plate, and the surface is angled from the offset attachment end 25*a* to enable general alignment of the stored arrows with the arrow head receiver unit and/or access to the cable guard mounting screw. It should be understood that any suitable means mounting the arrow shaft receiver unit to the cable guide and/or the elastomeric element to the holding plate is contemplated as within the broad invention. The clips are configured in spaced apart alignment on the elastomeric element and have internal radii, which is sized to securely grip along the shaft of an arrows but allow ready removal of the arrow when desired. Such arrangement of clips allows the archer to easily remove and load an arrow by manipulating the arrow shaft with a finger and/or thumb and/or by forcibly inserting a finger and/or thumb between the arrow and the unit, without significant hand or arm movement.

Arrow head receiver unit 40 is also illustrated in exploded format, and is shown as comprising hood 41, arrow head support element 42 and mounting plate 43. Hood 41 comprises spacer plate 41*a* and holes 41*b* through which screws 44 mounted to threaded holes 43*a* of mounting plate 43. Mounting plate 43 is mounted to attachment hole 20 of riser 12 by bolt 23. Arrow head support element 42 is illustrated as comprising a formed block of foamed material, preferably a foamed resilient polymeric material, which is configured to grippingly engage a plurality of arrow heads.

In a preferred embodiment of the invention, mounting plate 43 is mounted closely spaced from the launch plane of the bow and generally parallel thereto. In a further preferred embodiment, spacer plate 41*a* is beveled so that when the hood is mounted to the mounting plate it is angled to generally align with the arrow shaft receiver unit. I should be understood that it is contemplated as within the invention that the mounting plate and/or hood may be angled to provide suitable alignment, and/or that the foamed material be configured to accept a plurality of arrows at an aligned angle with the arrow shaft receiver unit.

FIGS. 1 and 2 illustrate the balanced arrangement of the mounted quiver of the present invention. Therein arrow shaft receiver unit 47 is mounted to an interior surface of offset elongate member 25*a* of the cable guide, and the offset of the guide arranged so that arrow shaft receiver unit 47 is positioned closely proximate to the launch plane of the bow, but below handgrip 24. Attachment plate 43, attaches to the bow above handgrip 24, with arrow head receiver unit 40 being bolt mounted thereto retaining the arrow head receiver unit spaced from the launch plane of the bow. In such arrangement, the head of the arrows are maintained in the quiver closely proximate one side of the launch plane, while the notched end of the arrows are maintained to the other side of the launch plane. Such retention of the arrows provides a balanced weight distribution of the arrows about at the launch plane, which minimizes torque of unbalanced distribution.

Figure 3:
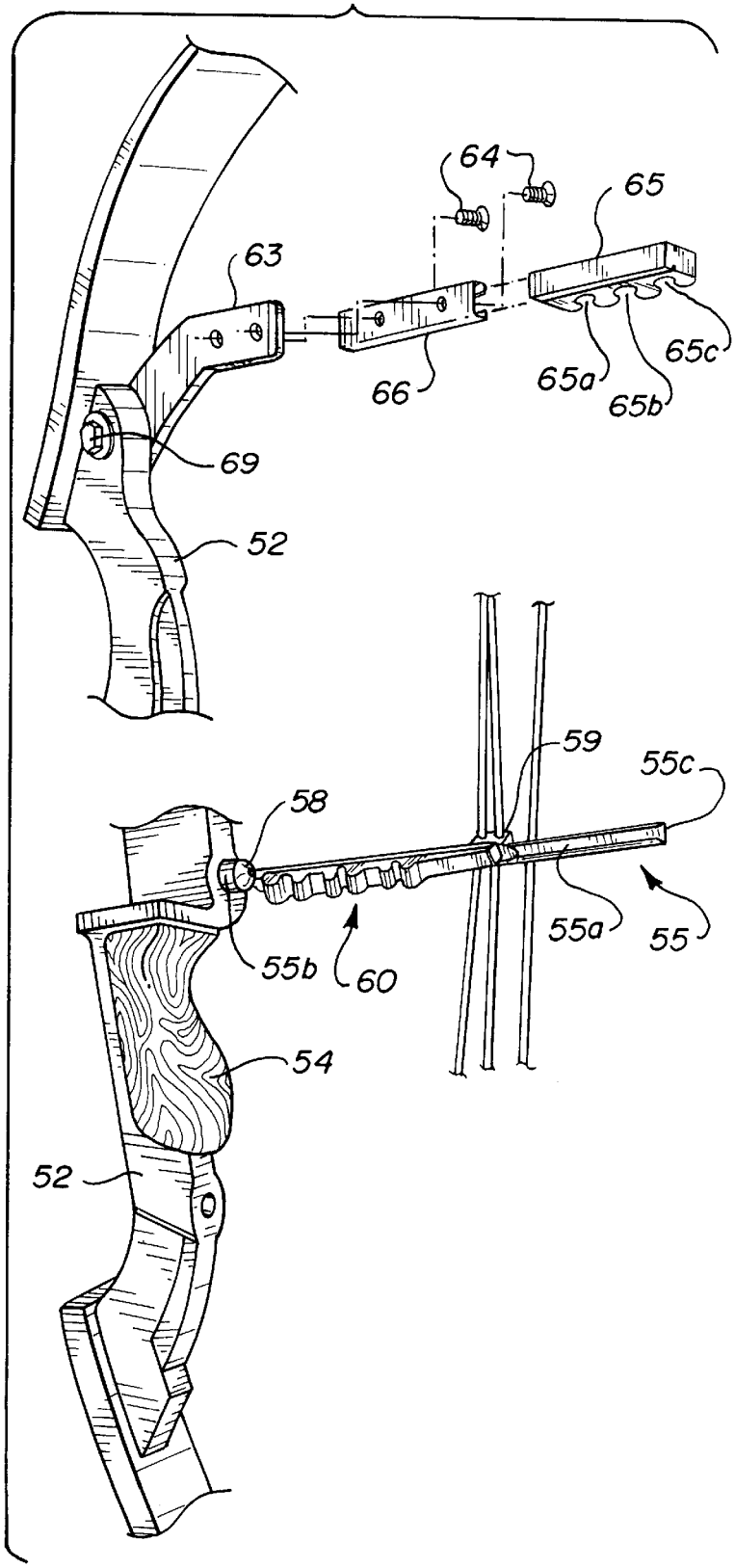
FIG. 3 is a rear perspective, fragmented view of a bow, illustrating a riser having another quiver arrangement mounted for holding a plurality of arrows in accordance with the invention.

FIG. 3 is a rear perspective view of a bow riser 52 comprising another quiver arrangement for holding a plurality of arrows in accordance with the invention. In this arrangement, cable guide 55 is illustrated as being attached to a mounting hole of riser 52 above handgrip 54 by bolt means 58. As in FIG. 2, cable guide 55 is depicted as comprising offset mounting end 55*b* and elongate guide member 55*a* having rounded surface 55*c* for slidably engaging a mating rounded surface of cable harness restraint 59. Arrow shaft ma receiver unit 60 is illustrated being mounted to a surface of the cable guide generally opposite rounded surface 55*c* of elongate guide member 55*a* as shown in FIGS. 1, 2 and 4.

In this embodiment, the offset of the cable guide is arranged so that arrow shaft receiver unit 60 is positioned closely proximate to the launch plane of the bow, but above handgrip 24, such that the shafts of stored arrows cross the launch plane of bow at a point below the handgrip.

In the embodiment of FIG. 3, the arrow head receiver unit is illustrated in exploded format, as being closely similar to the arrow shaft receiver unit and comprising a holding plate 66 and a resilient elastomeric element 65 mounted thereto, with elastomeric element 65 comprising a plurality of integral "U" shaped resilient gripping clips 65*a–c* formed therein arranged to engage the shaft of the arrow. The holding plate is illustrated as screw mounted to mounting plate 63 by screws 64, the mounting plate being in turn mounted to riser 52 by bolt 69. In this embodiment, the arrow is supported at the shaft thereof just below the arrow head.

In the mounting arrangement of FIG. 3, the distance between the arrow head receiver and the arrow shaft receiver is shortened, and the angle at which arrows cross the launch plane of the bow is shallower than that illustrated in FIGS. 1 and 2, providing a bow silhouette that is slimmer while continuing to enable balanced weight distribution at about the centerline of the bow.

I claim:

1. The combination of an arrow quiver and archery bow comprising:

an archery bow having a riser section comprising a cable guard extending therefrom;

an arrow head receiver, configured to grip a plurality of arrows at about an arrow head containing end of said arrows;

an arrow shaft receiver, configured to grip shafts of said plurality of arrows at a point spaced rearwardly along said arrows from their respective arrow head ends;

wherein said arrow head receiver is mounted to said riser section of said bow arranged above the centerline of said bow, said cable guard extending from said riser section at a point below said arrow head receiver comprising said arrow shaft receiver, and an arrow gripped by said arrow head receiver and said arrow shaft receiver is held in a plane crossing the arrow launch plane of said bow.

2. The combination of claim 1 wherein said riser section comprises a hand grip.

3. The combination of claim 2 wherein said cable guard is mounted to said riser below said hand grip.

4. The combination of claim 2 wherein said cable guard is mounted to said riser above said hand grip.

5. The combination of claim 1 wherein said cable guard comprising said arrow shaft receiver is removably mounted to said riser.

6. The combination of claim 1 wherein both said arrow head receiver and said arrow shaft receiver are arranged to grip an arrow on the same side of said arrow launch plane.

7. The combination of claim 1 wherein said arrow head receiver is arranged to grip an arrow spaced to one side of said arrow launch plane, and said arrow shaft receiver is arranged to grip an arrow shaft along the arrow launch plane.

8. The combination of claim 1 wherein said arrow head receiver is arranged to grip an arrow spaced to one side of said arrow launch plane, and said arrow shaft receiver of said cable guard is arranged to grip an arrow shaft spaced to the other side of the arrow launch plane of said bow.

9. The combination of claim 2 wherein said cable guard comprises an elongate member, said arrow shaft receiver is mounted to said cable guard generally along said elongate member and comprises a resilient elastomeric element having a plurality of spaced apart resilient clips arranged to engage the shaft of a plurality of arrows.

10. The combination of claim 9 wherein said cable guard comprises an elongate member with an offset end, said elongate member comprising a generally flat surface for mounting said arrow shaft receiver.

11. The combination of claim 9 wherein said arrow shaft receiver comprises a backing plate and elastomeric element, said backing plate being removably mounted to said elongate member and said elastomeric member being removably mounted to said backing plate.

12. The combination of claim 11 wherein said arrow head receiver comprises a hood mounted to a bracket, said hood comprising resilient polymeric foam into which a plurality of arrow heads can be inserted to be retained in spaced alignment.

13. The combination of claim 1 wherein said arrow head receiver is mounted to a bracket which in turn is mounted to the riser section of said bow.

14. The combination of claim 1 wherein said arrow head receiver comprises a resilient elastomeric element having a plurality of spaced apart resilient clips arranged to engage the shafts of a plurality of arrows.

15. A cable guard, for use in an archery bow, said cable guard having an integral elongate body comprising an offset first end, a middle section and distal end section, said offset first end being enabled for attachment of said cable guard to a riser section of an archery bow in an arrangement which positions the middle section offset from the centerline of said attachment, said distal end section having a surface arranged to enable guiding a bow cable, and said middle section having an arrow shaft receiver means arranged to removably grip a plurality of arrows on a surface opposite said surface arranged for guiding said bow cable.

16. A cable guard of claim 15 wherein said arrow shaft receiver means is mounted to a generally flat surface.

17. A cable guard of claim 15 wherein said surface arranged to enable guiding said bow cable is curved and said arrow shaft receiver means is mounted to a generally flat surface.

18. A cable guard of claim 15 wherein said arrow shaft receiver means comprises a resilient elastomeric element having a plurality of spaced apart resilient clips arranged to engage the shaft of a plurality of arrows.

19. A cable guard of claim 18 wherein said arrow shaft receiver means comprises a backing plate and said elastomeric element, said backing plate being removably mounted to said generally flat surface of said cable guards and said elastomeric element being removably mounted to said backing plate.

20. An arrow quiver comprising:

an arrow head receiver, configured to grip a plurality of arrows at about an arrow head containing end of said arrows;

an archery bow cable guard having an integral elongate body configured to enable guiding an archery bow cable, said body having an offset first end, a middle section and a distal end section, said offset first end being enabled for attachment of said cable guard to a riser section of an archery bow in an arrangement which positions the middle section offset from the centerline of said attachment, and said middle section comprising an arrow shaft receiver means arranged to removably grip a plurality of arrows.

21. The arrow quiver of claim 20 wherein said arrow head receiver comprises a hood mounted to a bracket, said hood comprising resilient polymeric foam into which a plurality of arrow heads can be inserted to be retained in spaced alignment.

22. The arrow quiver of claim 20 wherein said arrow head receiver comprises a resilient elastomeric element having a plurality of spaced apart resilient clips arranged to engage the shafts of a plurality of arrows.

23. The arrow quiver of claim 20 wherein said cable guard has an offset end arranged for mounting said cable guard to said archery bow and said arrow shaft receiver comprises a resilient elastomeric element having a plurality of spaced apart resilient clips arranged to engage the shaft of a plurality of arrows.

* * * * *